US007820993B2

(12) United States Patent
Fehrenbacher et al.

(10) Patent No.: US 7,820,993 B2
(45) Date of Patent: Oct. 26, 2010

(54) MULTI-LAYERED RADIATION PROTECTION WALL AND RADIATION PROTECTION CHAMBER

(75) Inventors: George Fehrenbacher, Muhltahl (DE); Torsten Radon, Ober-Morlen (DE)

(73) Assignee: GSI Helmholtzzentrum fur Schwerionenforschung GmbH (DE)

( * ) Notice: Subject to any disclaimer, the term of this patent is extended or adjusted under 35 U.S.C. 154(b) by 239 days.

(21) Appl. No.: 11/794,190

(22) PCT Filed: Nov. 19, 2005

(86) PCT No.: PCT/EP2005/012404

§ 371 (c)(1),
(2), (4) Date: Apr. 30, 2008

(87) PCT Pub. No.: WO2006/072279

PCT Pub. Date: Jul. 13, 2006

(65) Prior Publication Data

US 2008/0308754 A1 Dec. 18, 2008

(30) Foreign Application Priority Data

Dec. 29, 2004 (DE) ..... 10 2004 063 732

(51) Int. Cl.
*G21F 7/00* (2006.01)
*G21F 1/08* (2006.01)

(52) U.S. Cl. ..... 250/517.1; 250/505.1; 250/507.1; 250/515.1; 250/518.1

(58) Field of Classification Search ..... 378/203, 378/193; 250/505.1, 506.1, 507.1, 515.1, 250/517.1, 518.1; 315/500, 501, 502, 503, 315/504, 505; 376/108, 110, 112
See application file for complete search history.

(56) References Cited

U.S. PATENT DOCUMENTS

| | | | | |
|---|---|---|---|---|
| 4,658,142 | A * | 4/1987 | Johnson et al. | 250/393 |
| 4,876,593 | A * | 10/1989 | Bauer et al. | 348/83 |
| 6,518,586 | B1 * | 2/2003 | Heberer | 250/515.1 |
| 2002/0166293 | A1 | 11/2002 | Zeik et al. | |
| 2004/0188638 | A1 * | 9/2004 | Mossor et al. | 250/515.1 |
| 2004/0217307 | A1 * | 11/2004 | Bruchle et al. | 250/518.1 |
| 2006/0219960 | A1 * | 10/2006 | Shimojo et al. | 250/518.1 |

FOREIGN PATENT DOCUMENTS

| | | |
|---|---|---|
| EP | 0147147 | 7/1985 |
| EP | 1460641 A1 | 9/2004 |
| JP | 62032394 | 2/1987 |

(Continued)

*Primary Examiner*—Jack I Berman
*Assistant Examiner*—Nicole Ippolito Rausch
(74) *Attorney, Agent, or Firm*—Reising Ethington PC

(57) ABSTRACT

The invention relates to a multi-layered radiation protection wall for shielding against gamma and/or particle radiation of a reaction site of an accelerator facility, wherein the radiation protection wall comprises a sandwich-like structure with at least a first and a second layer arrangement, wherein the first layer arrangement has at least a primary shielding layer and the second layer arrangement has at least a secondary shielding layer. Thereby, at least one of the first and the second layer arrangements is sub-divided into a plurality of wall segments, whereby a selective disposal is made possible. Thus an increased cost efficiency is achieved and the environmental impact is lowered.

12 Claims, 5 Drawing Sheets

FOREIGN PATENT DOCUMENTS

| | | |
|---|---|---|
| JP | 62032395 | 2/1987 |
| JP | 02268298 | 11/1990 |
| JP | 03013895 | 1/1991 |
| JP | 2001305278 | 10/2001 |
| JP | 2004020414 | 1/2004 |
| JP | 2004333345 | 11/2004 |
| WO | WO2004/013865 | 2/2004 |
| WO | WO 2004/064077 | 7/2004 |

* cited by examiner

MULTI-LAYERED RADIATION PROTECTION WALL AND RADIATION PROTECTION CHAMBER

CROSS REFERENCE TO RELATED APPLICATION

This application claims benefit of priority of Patent Cooperation Treaty patent application PCT/EP05/12404 filed Nov. 19, 2005, which in turn claims benefit of priority to German patent application 10 2004 063 732.6 filed Dec. 29, 2004, both of which are hereby incorporated by reference in their entireties.

FIELD OF THE INVENTION

The invention relates to a multi-layered radiation protection wall for shielding against gamma and/or particle radiation, particularly for shielding against radiation of a reaction site on a high energy accelerator facility, and a radiation protection chamber with the radiation protection wall.

BACKGROUND OF THE INVENTION

High energy accelerators for particle beams are used more and more throughout the world. In doing so, intensity and energy are increased permanently. For instance, currently proton accelerators with energies up to the range of tera-electron volt (TeV) are planned and proton accelerators with energies up to some giga-electron volt (GeV) and intensities up to $10^{16}$ protons/sec are planned, e.g. for spallation sources.

The latter accelerators are not only planned as neutron sources for fundamental research, but are also discussed as nuclear facilities for energy production, by which subcritical systems can be brought into a critical state by an additional neutron flow. Furthermore, those facilities can be used for the so-called incineration, during which long-lived radioactive substances are changed into short-lived ones.

When running high energy accelerators, one problem is the production of high-energy secondary radiation in the target areas (Target of the particle beam, in which it is deposited) or in case of beam losses during the transport on the path of the beam guidances of the high energy or primary beam to the target.

While the charged particles generated in nuclear reactions are often stopped in the structure of the accelerator, the generated neutron and gamma radiation has a high capability for permeating, even through shieldings with a thickness of some meters. Furthermore, at very high energies inter alia pions are generated, which decay into muons. Latter have also a very high range and have therefore to be stopped in special beam annihilators.

In case of heavy ion accelerators the situation is yet more difficult, because already at lower intensities similar production rates for secondary radiation arise, compared to proton accelerators. So far, the production of radiation at such accelerator facilities caused the installation of mostly very massive shieldings at the places of beam losses.

Often iron or concrete was used as shielding material like in nuclear technology. Such concrete shieldings consist of hard-casted walls and ceilings, but also single shielding modules assembled from single parts can form an overall shielding.

For special shielding requirements heavy varieties of concrete with appropriate additives like magnetite, limonite or barite, concrete with densities up to 3.6 g/cm$^3$ can be used besides normal concrete with a density in the range of 2.3 g/cm$^3$ (see also Deutsche Industrienorm DIN 25413). But in practice, normal concrete is mostly used in the sense of optimizing cost and attained shielding result.

Producing the radiation depends on the kind of radiation, the energy, the intensity and the loss rate. Furthermore, the shielding thickness depends on limit values to be met according to the national legislations. The limit values are defined as annual dose limit values or are referred to the dose rate in μSv/h.

Recently, using shielding arrangements with bulk material was proposed. For instance, gypsum or iron ore were proposed as bulk material. Though being naturally occurring material was heaped up around these facilities as soil up to now, but not incorporated directly into the shielding. On the other hand, the problem of activation arises, when natural material is used in the shielding arrangement, because this material is relatively close to the sources.

From the patent applications DE 103 27 466 (Forster) and DE 103 12 271 A1 (Brüchle et al.) gypsum is known as alternative material for parts of a radiation protection structure and the shieldings of high energy accelerators respectively. This material proved to be well suited as shielding material, too.

Using such shieldings, which have bulk material as shielding substance, implicates some enhancements, but the previous developments and proposals to construct shieldings for accelerator facilities have mostly been planned in particular consideration of the shielding properties.

A further effect addressed by the present invention, being important and due to the inventors' findings not being sufficiently considered so far is the activation of the radiation protection material itself, particularly the generation of radioactivity by secondary radiation, which causes nuclear reactions in the shieldings. In these unwanted side-effects the generation of radionuclides is particularly caused in spallation reactions by protons and is neutrons in the shielding layers. A plurality of radionuclides can be generated by evaporation of nucleons and clusters. This problem is yet deteriorated by the fact that the heavier the target nucleus of the used shielding material is, the greater the variability of the generated radionuclids becomes.

If natural material, which should be recirculated to a natural utilization after termination of using the facility, is used for shielding purposes, the level of the generated radioactivity has to go below certain limits in order to comply with the specifications of the national legislation. So, for example, one has to go below under a nuclide-specific approval value $A_i$ in Bq/g for the unlimited release according to German radiation protection law. In case of several radionuclides the total exhaustion after applying the sum rule has to be less than one. The total exhaustion is defined as:

$$G = \sum_{i=1}^{\max} \frac{A_i}{F_i},$$

Where $F_i$ is the real activity per mass and radionuclide and where one has to be sum up over all radionuclides (i).

According to German law there is still a further limit value for the restricted release beside the unlimited release (able for being deposited), but irrespective of potential legal limit values, an activity is desirable, which is as low as possible.

Calculations by the inventors, however, showed that, when operating a high energy accelerator facility at very high intensities over several decades, the used shielding material is activated so highly that it is not able for being cleared after switching off the facility and in the deconstruction phase, not even for restricted release as the case may be, and it has to be stored for years or decades before it can be released. This applies also for natural filler material (soil, sand, water etc.), which is used just for the reason to be recirculated to a natural utilization as soon as possible after terminating the using of the facility. But if its exhaustion is above the legal limits, this object cannot be met, because the material would have to be stored intermediately or would have to be disposed with enormous costs as radioactive waste.

From the patent application DE 103 27 466 A1 a structure with a sandwich construction method for a radiation protection building is known. This structure, however, comes from a room for medical proton treatment, whose requirements are not comparable, because of the essentially lower energies.

Summarizing, especially multi-layered radiation protection arrangements or walls for high energy accelerator facilities have to be further improved with respect to the radioactive activation of the material and its deactivation properties, in consideration of operating over several years or decades with high beam energies and intensities and the disposal thereafter. Particularly, this aspect is of special importance, if natural shielding material is used, which on the one hand is radioactively activated after having operated the facility and on the other hand there is few experience in handling higher quantities of such material.

SUMMARY OF THE INVENTION

Therefore, it is the object of the invention to provide a multi-layered radiation protection wall, particularly for shielding against high energy gamma and/or particle radiation from high energy and/or nuclear reactions for a radiation protection chamber, which offers a well manageable radioactive activation with respect to the future disposal of the used material also after a long time of operation and high beam energies and intensities, and whose parts can be reused at least partially.

It is a further object to provide such a radiation protection wall for a high energy accelerator facility, with which at the time of deconstruction as few as possible material incurs, which has to be disposed as activated, and as much as possible material is below under the predefined limits and can be reused.

Particularly it is an object of the invention to provide such a radiation protection wall and a radiation protection chamber, which can be produced, assembled, disassembled and disposed cost-efficiently and with little work.

It is a further object to provide such a radiation protection wall and a radiation protection chamber, which avoid or at least lower the disadvantages of known shieldings.

The object of the invention is achieved by subject matter of the independent claims. Preferred embodiments are defined in the dependent claims. According to the invention a multi-layered radiation protection wall is provided for shielding against high energy gamma and/or particle radiation, particularly from high energy or nuclear reactions, generated by a primary beam in the range above 1 GeV, particularly above 10 GeV or even higher. Preferably, the radiation of a reaction site on a high energy particle accelerator facility is shielded or attenuated herewith. In the most applications, the radiation to be shielded is secondary radiation generated by a reaction of the primary beam with a target, but it can also be a residual or a part of the primary beam itself.

The radiation protection wall has a sandwich-like structure with at least a first and a second layer arrangement, wherein the first layer arrangement comprises at least a primary shielding layer and the secondary layer arrangement comprises at least a secondary shielding layer, particularly consisting of different material and being functionally different.

In order to be able to shield the high energy radiation efficiently, the primary shielding layer is preferably constructed as spallation layer and the secondary shielding layer preferably as moderation layer.

According to the invention, the first or the second layer arrangement, particularly preferred both, are multi-layered is or divided into a plurality of adjacent and already during assembling predefined separable wall segments, so that a simple and separated disassembling and a separated and selected reuse or disposal of the wall segments are made possible. Dividing into wall segments can be implemented by dividing into several adjacent separated moderation layers and/or spallation layers and/or by separating the moderation layer(s) and/or the spallation layer(s) laterally (across the plane defined by the layer).

This offers the enormous advantage that already when planning the radiation protection wall and the radiation protection chamber respectively, a so-called "cave", which is made at least partially from such radiation protection walls, one can differentiate between wall segments with predictably high exposure doses and wall segments with predictably low exposure doses, and that these wall segments can be assembled dividably or separably, in order to be able at disassembling to dispose the more and the less exposed wall segments separately and/or to reuse them. By doing so the costs of disposal can be reduced considerably.

With other words: According to the invention the wall segments, which are highly activated by the operation, can be separated from the wall segments, which have shielding properties and are less activated, i.e. their activity level is lower. Soon after terminating the usage, these layers, which can contain natural material and are only lowly activated, are ready for release for unlimited use or at least for disposal and are ready for a natural usage again. It is apparent that the invention is not restricted to comply with any national limit value regulations.

After close-down, the higher activated wall segments are either stored intermediately or used in other comparable nuclear facilities further.

Preferably, the first and/or the second layer arrangement are constructed separably multi-layered on their part. With other words: The first layer arrangement comprises a plurality of 2, 3 or more spallation layers and/or the second layer arrangement comprises a plurality of 2, 3 or more moderation layers to achieve a separability along the normal of the layer additionally to the lateral separability. Herewith, concerning the concept development in two dimensions—in polar coordinates azimuthal and radial—planning the disassembling can be adjusted to the expected exposure dose, so that a two-dimensionally modular or differentiated disassembling is possible.

These advantages have special effects, if the moderation layer(s) and/or the spallation layer(s) are made from bulk material layers, because in this case a separated disassembling can be done especially simple.

In order to confine the bulk material layers, the radiation protection wall has a solid statics-giving concrete base layer. Furthermore, (thin) dividing walls, for instance made from concrete, are provided between the spallation and the moderation layers to ensure the separated disposal. At the narrow side, laterally adjacent sections of bulk material layers are separated from each other by dividing elements. With other words: The dividing layers and the dividing elements form boxes adjacent to each other or volumes to be filled, into which the spallation material and the moderation material respectively are filled, in order to form the two-dimensionally sub-divided radiation protection wall.

According to a particularly preferred embodiment of the invention, at least one lateral position, particularly in a central area, the radiation protection wall provides in downbeam direction at least the following layer structure in the following order:

a first solid (concrete) base layer,
a spallation layer,
a first dividing wall,
a first moderation layer,
a second dividing wall,
a second moderation layer,
a second solid (concrete) base layer.

Preferably, several or all moderation layers or sections contain mainly (more than 50%) elements with an atomic number lower than 30 or consist of such elements. These elements are especially suited to moderate light nuclear fragments and nucleons. For moderation, particularly of neutrons, moderation layers made from gypsum or material with bound water have proven to be particularly suited. But also fluid sections or layers are imaginable, e.g. made from water. Furthermore, it has appeared that simple soil, sand, flint, feldspar, lime feldspar, potassic feldspar or similar natural raw material can be used as moderation layer(s).

But the spallation layer(s) placed upbeam of the moderation layers contain mainly (greater than 50%) elements with an atomic number above 20 or 25 or consists of such elements. For example, an iron containing material has particularly proven its worth as spallation material. This material can be obtained at low costs and can preferably be disposed or reused as the case may be.

Preferably, the moderation layer(s) have a density less than or equal to 3.5 g/cm$^3$ and the spallation layer(s) have a density greater than or equal to 3.0 g/cm$^3$.

Particularly, the radiation protection wall according to the invention defines the downbeam positioned wall of the radiation protection chamber, into which a primary high energy beam from a particle accelerator is directed onto a reaction site or a target.

Therefore, the radiation protection chamber has at least the following components:

A first radiation protection wall placed downbeam and having the above described divided structure,
a second radiation protection wall placed upbeam and having an entry area for the high energy beam,
lateral radiation protection walls as well as
a floor and a ceiling,
wherein the radiation protection walls, the floor and the ceiling jointly form a radiation protection cage substantially closed around the reaction site.

Thereby, thus the first radiation protection wall provides a central area to attenuate the radiation being emitted from the reaction site in a predefined solid angle around the forward direction of the high energy beam and a peripheral area around the central area and is constructed from separated wall segments such that during disassembling wall segments from the central area and wall segments from the peripheral area are able to be disassembled or deconstructed separately from each other and are able to be reused or disposed.

The lateral radiation protection walls may have a layer structure different thereof.

At especially high beam energies it can be advantageous, if an additional beam annihilator, so-called "Beamdump", is placed in forward direction of the primary high energy beam or downbeam of the reaction site. The beam annihilator is preferably joint downbeam to the first radiation protection wall outside the radiation protection chamber or is at least partially integrated into the radiation protection wall.

In the following the invention is described in more detail by means of embodiments and with reference to the drawings, wherein same and similar elements are partially provided with same references and the features of the different embodiments may be combined with each other.

DETAILED DESCRIPTION OF THE INVENTION

The irradiation chamber for nuclear collisions, which is currently planned by the assignee of the present application in the context of the project FAIR (=Facility for Antiproton and Ion Research), is used as an example for the radiation protection wall according to the invention.

Figure 1:
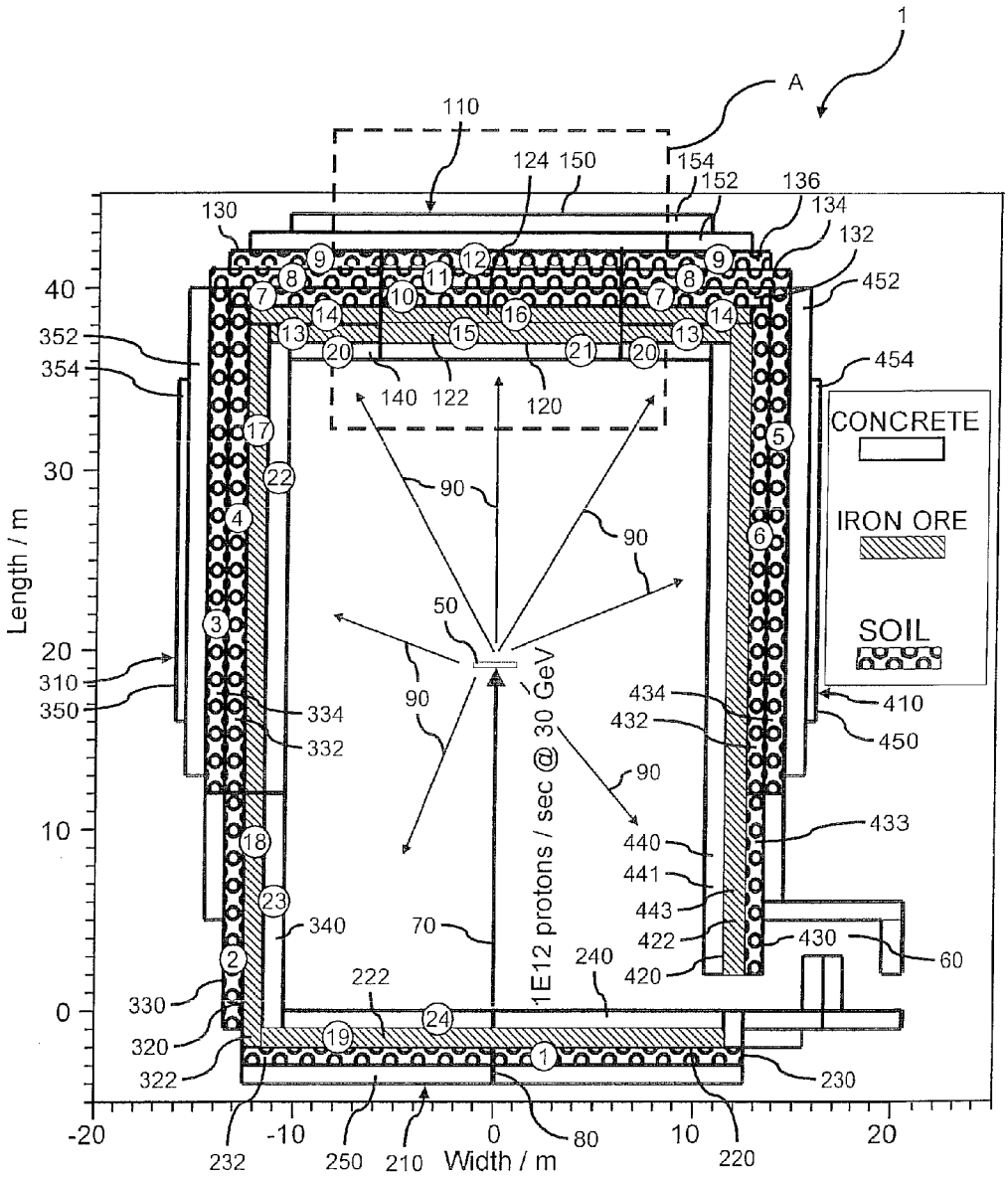
FIG. 1 a schematic top-view cross-section through a radiation protection chamber according to a first embodiment of the invention, FIG. 2 section A from FIG. 1, FIG. 3 a calculated dose profile at the radiation protection chamber according to FIG. 1, FIG. 4 a calculated radioactivity, split according to isotopes of section 8 in FIG. 1, FIG. 5 a schematic top-view cross-section through a radiation protection chamber according to a second embodiment of the invention.

FIG. 1 shows this radiation protection chamber 1 constructed from a first radiation protection wall 110 positioned downbeam (front), a second radiation protection wall 210 positioned upbeam (rear) and two lateral radiation protection walls 310, 410, which together with the floor (not shown) and the ceiling (not shown) form a cage substantially closed as reaction cave around a target 50. The chamber 1 has a labyrinth-like entry area 60.

The high energy primary beam 70 enters the chamber 1 through a beam entry area 80 and hits the target 50. Though the primary beam 70, in this example $10^{12}$ protons/sec with an energy of 30 GeV, generates secondary radiation 90, which is emitted in all directions, but nevertheless has a maximum in the forward direction. Particularly, this secondary radiation 90 shall be shielded effectively.

Each of the radiation protection walls 110, 210, 310, 410 has an inner solid base layer or supporting concrete layer 140, 240, 340, 440 and an outer solid base layer or a supporting concrete layer 150, 250, 350, 450. The front and lateral outer concrete layers 150, 350 and 450 are on their part two-layered in layers 152, 154; 352, 354 and 452, 454 respectively.

Furthermore, each of the radiation protection walls 110, 210, 310, 410 has an inner layer structure 120, 220, 320, 420 made from a spallation material like iron, iron granulate or iron ore. The front spallation layer arrangement 120 is on its part two-layered in spallation layers 122, 124. The lateral spallation layer arrangements 320, 420 have only one spallation layer 322, 422 each.

Externally adjacent to each of the spallation layer arrangements 120, 220, 320, 420 there are moderations layer arrangements 130, 230, 330, 430 made from soil. The front moderation layer arrangement 120 is on its part three-layered in moderation layers 132, 134, 136. Each of the lateral moderation layer arrangements 330, 430 has two moderation layers 332, 334 and 432, 434 respectively.

The concrete layers 140, 152 serve as inner and outer base wall for filling with iron ore bulk material for the spallation layers and bulk soil for the moderation layers. The soil has a composition as it is usual at the location of the research establishment. Intermediate layers and a tension anchor (not shown in FIG. 1) are installed to fulfil the statical requirements.

The spallation layers consist of material with an atomic number higher than the atomic number of the material of the moderation layers. In the spallation layers mainly spallation reactions are caused by high energy neutrons, which lead inter alia to the production of volatility neutrons. The volatility neutrons have lower energies than the neutrons of the secondary radiation, generation of further radionuclides take place with a lower probability. If the thickness of the layer is large enough, a bigger part of the neutrons of the secondary radiation is converted into neutrons of the volatility nuclei. If this thickness of the layer is fitted to the primary beam (kind of ion, energy, intensity) and to the target (element, thickness) in such a manner that the secondary radiation generated in the target is strongly scattered and attenuated, the layers following downbeam are only lowly activated, the level of generated radioactivity is low.

Particularly, the front radiation protection wall 110 or rather its layers are subdivided into wall segments on the one hand laterally, i.e. perpendicular to the respective plane of layer, and on the other hand by dividing the layer arrangements 120, 130 into further separated layers 122, 124 and 132, 134, 136. The Sub-dividing is made in this example outwards from the inner as follows:

The inner concrete layer 140 has a central wall segment 21 and two peripheral wall segments 20.

The first spallation layer 122 has a central wall segment 15 and two peripheral wall segments 13.

The second spallation layer 124 has a central wall segment 16 and two peripheral wall segments 14.

The first moderation layer 132 has a central wall segment 10 and two peripheral wall segments 7.

The second moderation layer 134 has a central wall segment 11 and two peripheral wall segments 8.

The third moderation layer 136 has a central wall segment 12 and two peripheral wall segments 9.

The outer concrete layers 152, 154 are made one-piece.

Also the lateral radiation protection walls 310 and 410 are subdivided into wall segments as follows:

The inner concrete layer 340 has a first wall segment 22 and a second wall segment 23.

The only spallation layer 322 has a first wall segment 17 and a second wall segment 18.

The first moderation layer 332 has a first wall segment 2 and a second wall segment 4.

The second moderation layer 334 has only one segment 3.

The inner concrete layer 440 has only one segment 441.

The spallation layer 422 has only one segment 443.

The first moderation layer 432 has a first wall segment 6 and a second wall segment 433.

The second moderation layer 434 has only one segment 5.

Furthermore, concerning the rear radiation protection wall 210 the following applies:

The inner rear concrete layer 240 is made one-piece (segment 24).

The spallation layer 222 has only one segment 19.

The moderation layer 232 has only one segment 1.

The outer concrete layer 250 is made one-piece.

Dividing walls (not shown in FIG. 1) are provided between the spallation layers and the moderation layers.

Furthermore, wall segments being adjacent on the front side, e.g. the sections 13 and 15, are separated at their front sides by dividing elements.

Figure 2:
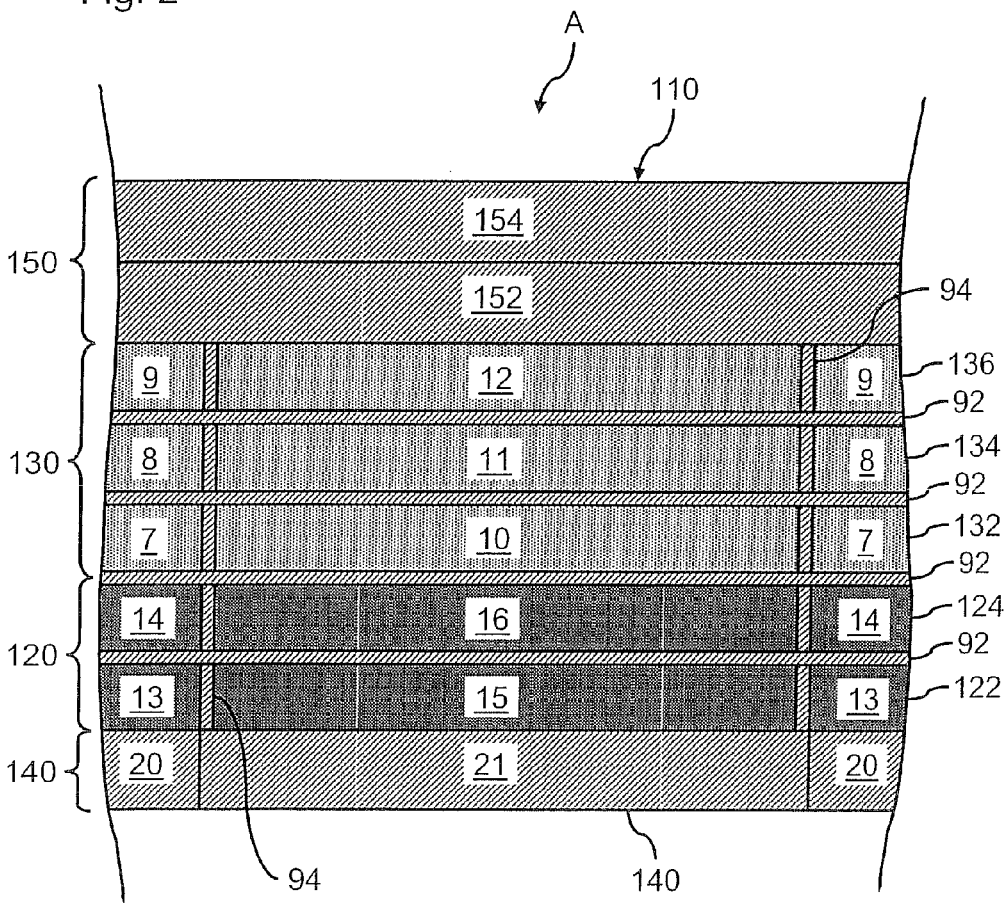

FIG. 2 shows a detail enlargement of the wall segments 15, 16 of the spallation layer and 10, 11, 12 of the moderation layer as well as the outer supporting concrete layers 152, 154 and the wall segment 21 of the inner supporting concrete layer 140. The wall segments of the spallation layer and of the moderation layer are delimited by the dividing walls 92 and the dividing elements 92 as well as by the adjacent supporting concrete layers.

Particularly, the front radiation protection wall is adapted to the anisotropy of the secondary radiation 90 by the sectional sub-dividing according to the invention.

The inner, i.e. the central, layer sections 21, 15, 16, which are oriented to the target have to provide the highest shielding properties and have therefore the highest activation. The other sections are less activated due to their peripheral position or their position being more outwards. Therefore, most of the remaining wall segments are ready to be released unlimitedly immediately after using the facility or after a short waiting time. Advantageously, on the one hand one can build in as few material with the necessary layer thickness and the unavoidably increased activation as necessary and on the other hand one can build in as much natural material as necessary, in order to achieve the dose rate to be below a certain value outside the chamber 1 or outside the facility.

Therefore, the invention described herein optimizes two parameters:

1. The distribution of the radioactivity inside the several wall segments 1-24 of the radiation protection wall 110, 210, 310, 410 and
2. the dose rate one has to go below outside the facility.

Particularly, concerning the front radiation protection wall 110 according to the invention the following applies:

the spallation layers 122, 124 are separated from the moderation layers 132, 134, 136, several spallation layers 122, 124 are separated from each other, several moderation layers are separated from each other and each of the spallation layers 122, 124 and the moderation layers 132, 134, 136 are laterally sub-divided into wall segments 13-16 and 7-12 respectively.

The various layers can be provided as solid layers (base concrete layers) or as bulk material layers (spallation layers, moderation layers) or even as fluid layers (moderation layers). More precisely, the moderation layers contain bulk material as shielding material, e.g. natural material like gypsum, soil, sand etc. and the inner and outer base layers 140, 152, 154 are ferroconcrete layers, which serve for structuring the chamber statically.

Figure 3:
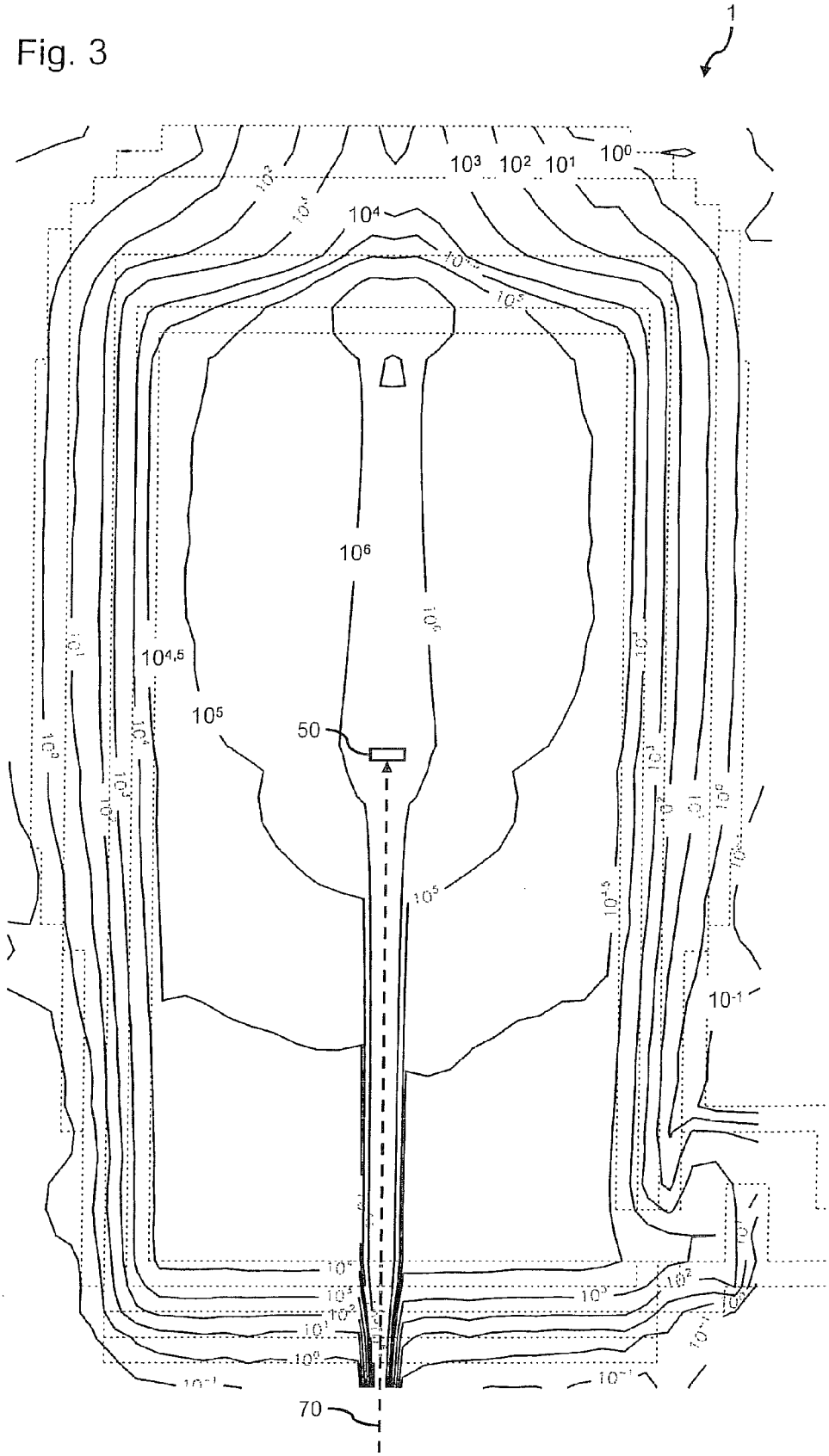

FIG. 3 shows a calculated dose profile for operation with a proton beam 70 with an energy of 30 GeV and an intensity of $10^{12}$ protons/sec. The dose rate is given in the unit μSv/h. The radiation chamber was optimized in two respects:

1. Low radiation levels are achieved outside the facility.
2. The regional activation inside the radiation protection walls is fitted to the natural shielding material soil.

In FIG. 3 it can be seen that, when using natural shielding material, in this example iron ore as spallation material and soil as moderation material, the generated radiation is attenuated efficiently. Near the target 50, the dose rate is very high (1 Sv/h and higher), outside the radiation protection chamber 1 (except directly in forward direction) it is on a level between 0.1 and 1 μSv/h. Therefore, the specifications of the national legal limits can be complied with.

The calculations have been done by using the radiation transport program FLUKA (A. Fasso, A. Ferrari, J. Ranft, P. R. Sala: New developments in FLUKA, modelling hadronic and EM interactions Proc. 3rd Workshop on Simulating Accelerator Radiation Environments, KEK, Tsukuba (Japan) 7-9 May 1997. Ed. H. Hirayama, KEK proceedings 97-5 (1997), p. 32-43).

In table 1 the activation in the various wall segments 1 to 24 is calculated for a beam time of 30 years and an average intensity of 1.00 E+12 protons/sec at 30 GeV. The target causes a proton reaction rate of about 1%. Thereby, an intensive high energy secondary radiation is generated (neutrons, protons, pions, muons). The secondary radiation in turn generates radioactivity in the shielding layers as follows.

Hereby, the sections 1 to 12 consist of soil, the sections 13 to 19 of iron ore and the sections 20 to 24 of concrete. The activation is given in units of the total exhaustion for the unlimited release for three different decay times, namely 5 years, 1 year and 1 month. Therein, values less than 1 mean unlimited release.

TABLE 1

| | Deactivation time | | |
|---|---|---|---|
| Section | 5 years | 1 year | 1 month |
| 1 | 4.00E−04 | 9.40E−04 | 1.28E−03 |
| 2 | 1.10E−04 | 2.66E−04 | 3.71E−04 |
| 3 | 4.60E−04 | 1.26E−03 | 1.80E−03 |
| 4 | 4.30E−03 | 1.04E−02 | 1.43E−02 |
| 5 | 4.50E−04 | 1.24E−03 | 1.78E−03 |
| 6 | 4.00E−03 | 9.89E−03 | 1.37E−02 |
| 7 | 5.80E−03 | 1.49E−02 | 2.09E−02 |
| 8 | 1.00E−03 | 2.88E−03 | 4.21E−03 |
| 9 | 3.40E−04 | 9.76E−04 | 1.43E−03 |
| 10 | 1.05E+00 | 2.73E+00 | 3.83E+00 |
| 11 | 2.61E−01 | 7.18E−01 | 1.02E+00 |
| 12 | 7.15E−02 | 2.01E−01 | 2.88E−01 |
| 13 | 8.33E−02 | 1.84E+00 | 4.95E+00 |
| 14 | 8.54E−03 | 1.87E−01 | 5.00E−01 |
| 15 | 4.62E+00 | 9.77E+01 | 2.75E+02 |
| 16 | 9.62E−01 | 2.07E+01 | 5.71E+01 |
| 17 | 9.15E−03 | 2.01E−01 | 5.14E−01 |
| 18 | 5.00E−04 | 1.08E−02 | 2.67E−02 |
| 19 | 9.67E−04 | 2.20E−02 | 5.40E−02 |
| 20 | 1.91E+00 | 5.65E+00 | 7.54E+00 |
| 21 | 3.63E+01 | 1.07E+02 | 1.42E−02 |
| 22 | 6.69E−01 | 2.00E+00 | 2.68E+00 |
| 23 | 4.88E−02 | 1.49E−01 | 2.05E−01 |
| 24 | 4.84E−02 | 1.49E−01 | 2.06E−01 |

It is apparent that almost all segments, which contain soil, are already able to be released unlimitedly after a decay time of one month. Only the segment 10 is, after one month with an exhaustion of 3.83, clearly above the release value.

Waiting for five years brings this layer down to a value of about 1.

Alternatively, also the thickness of the iron ore layer of segments 15 and/or 16 can be increased to bring the exhaustion of soil activation down to a value below 1 after a one-month decay time.

Partially, the concrete and the iron ore layer segments are highly activated. Thus, in forward direction the iron ore segments 15 and 16 have the highest activation with an exhaustion value of the release activity of 275 (segment 15) after an one-month decay time. Accordingly, the concrete layer placed before is also highly activated (segment 21 with a value of 142. As well a five-year waiting time is not sufficient to bring the exhaustion rate below one. This material is not able to be released unlimitedly, i.e. it can be used as shielding material in other facilities again or disposed according to the respective national radiation protection law.

Figure 4:
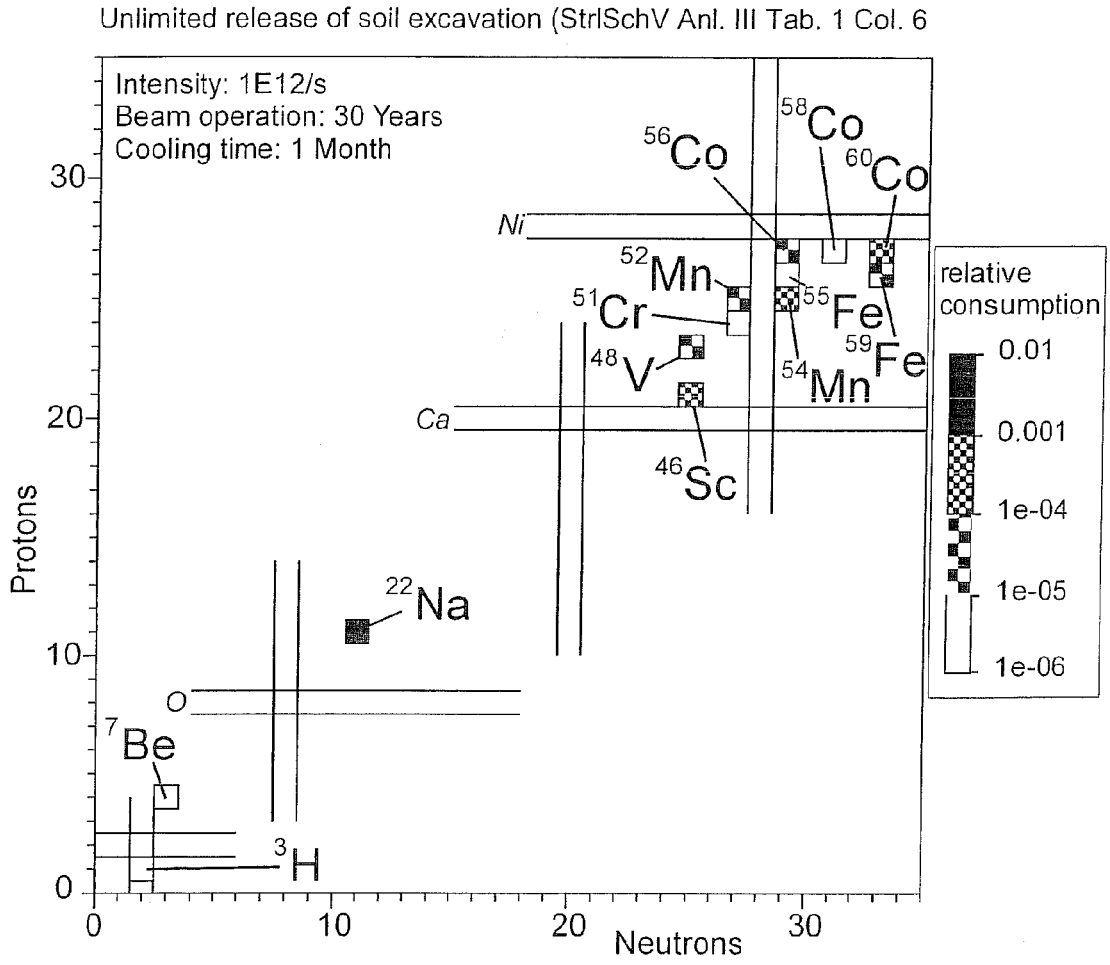

FIG. 4 exemplifies the distribution of the generated radioactivity for the wall segment 8, which consists of soil, from FIG. 1.

The most important generated radionuclides are indicated. The exhaustion rate of the release value (unlimited release) according to the German radiation protection regulation is is illustrated for a 30-year operation with $10^{12}$ protons/sec and an one-month decay time.

Here the radionuclide Na-22 (half-life time 2.6 years) has the highest relative exhaustion. Further radionuclides, which arise, are H-3, Be-7, Mn-52, 54, Sc-46, V-48, Cr-51, Fe-55, 59 and the cobalt isotopes Co-56, 58, 60.

Figure 5:
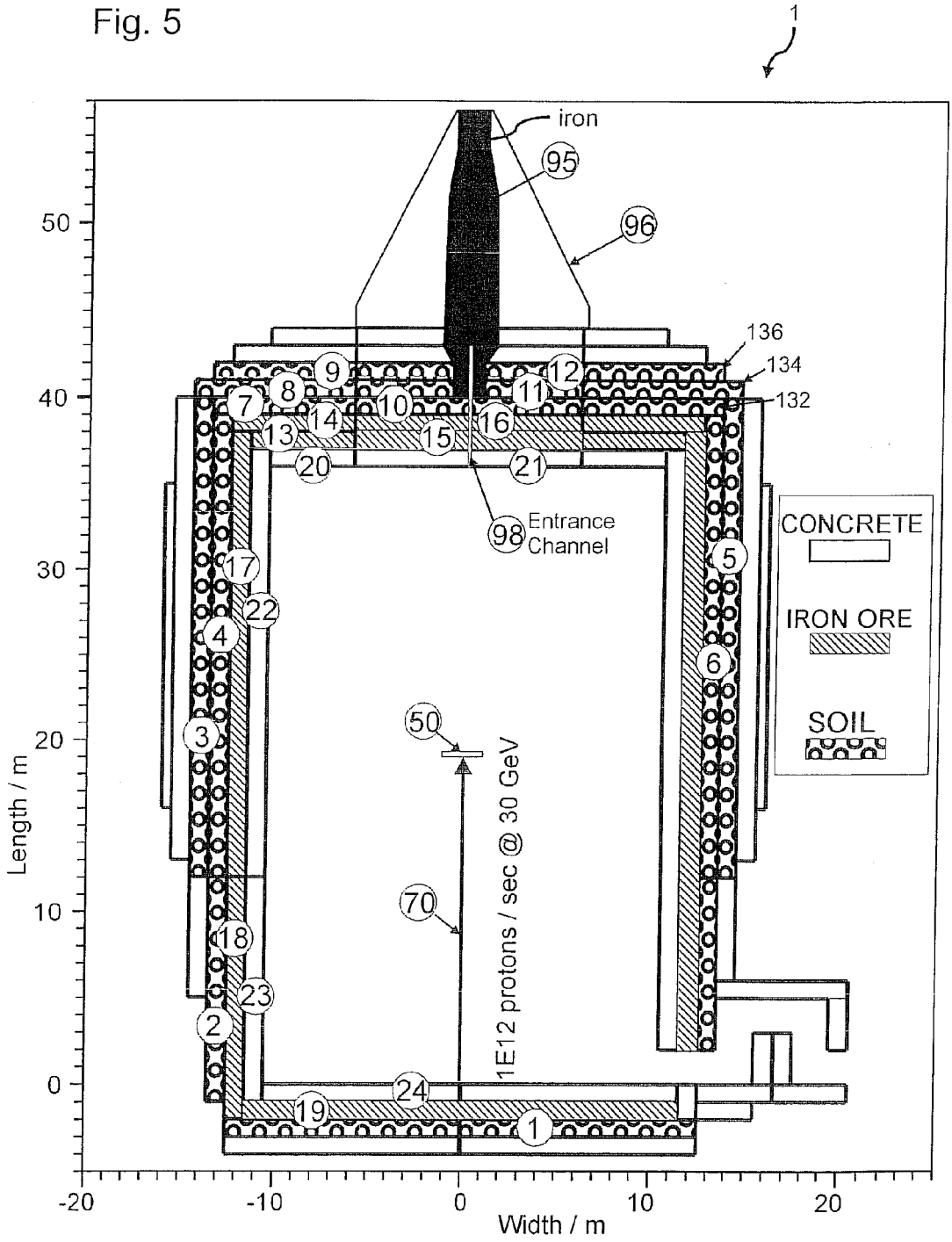

FIG. 5 shows a radiation protection chamber according to the one shown in FIG. 1, but with an additional beam annihilator 95 made from iron with a concrete casing 96. The beam annihilator 95 is centrally embedded into the moderation layers 132, 134, 136, more specifically into the sections 10, 11, 12, and thereby causes a further decreased activation of these sections. In the sections positioned upbeam from the beam annihilator and preferably in the entrance area of the beam annihilator 95 an entrance channel 98 provided.

Summarizing, taking into account the radioactivity, which arises in the different wall segments, during the construction of the shielding facility entails the following advantages:

1. Concentrating the radioactive fixtures in shielding layers, which can be easily separated from the layers, which are only slightly activated.
2. Separating slightly and higher activated layers is an optimisation with respect to radiation protection, because the total mass of the material to be disposed (or to be reused) is reduced and therefore the disposal is made easier.
3. Using natural shielding material (soil, sand, silt, gypsum etc.) has a twofold advantage: This material is mostly easy to be organized concerning supply and transport and it is easy to be disposed in the phase of disassembling (assuming that it is only slightly activated and it is at least below the legal exhaustion limits).
4. Transporting material, whereby this transport has necessarily be done from far (iron ore), to and from the facility is reduced to a minimum of that, what is really needed; mostly, the natural shielding material can be disposed near to or at the same place of the accelerator facility to be build. Therefore, the transport effort and the used energy is reduced.
5. After operating the facility for several years, when the decision for the facility to be deconstructed has to be made, one proceeds in such a manner that using the knowledge of the operating staff the facility shall be deconstructed as quickly as possible. This is thereby made easier that a clear separation exists between the segments, which are radioactively charged, and the segments, which are able to be released unlimitedly and/or limitedly. For this, during the deconstruction procedure one can better separate between the deconstruction phases, during which one shall work in danger of radioactive decontamination and possible direct exposition to radiation, and the deconstruction phases with pure conventional disassembling procedures. The effort to avoid the propagation of contamination and the necessary provisions for labour and radiation protection can be better fitted to the mentioned deconstruction phases.
6. A bigger part of the shielding masses can be unlimitedly released immediately after a long-time operation of the facility.

The invention, however, cannot only be used for high energy accelerator facilities, but can also be transferred to facilities, in which neutrons with lower energies or thermalized neutrons are released, like e.g. nuclear reactors for power generation or research reactors (Activation by capturing neutrons with n,γ-reactions) or spallation neutron sources. Generally, the invention is to be used for kinds of radiation, which cause an activation of substances and material in the radioactive sense.

It is apparent for the person skilled in the art that the foregoing described embodiments are to be understood as illustrative and that the invention is not restricted to these embodiments, but can be changed variously without departing from the scope and the spirit of the invention.

The invention claimed is:

1. Multi-layered radiation protection wall (110) for shielding against gamma and particle radiation, wherein said radiation protection wall (110) comprises a sandwich-like structure having at least one first and one second layer arrangement (120, 130), wherein said first layer arrangement (120) comprises at least one primary shielding layer (122, 124) and said second layer arrangement comprises at least one secondary shielding layer (132, 134, 136);

wherein said primary shielding layer is constructed as a spallation layer and said secondary shielding layer is constructed as a moderation layer, wherein at least one of said first and said second layer arrangements (120, 130) is sub-divided into a plurality of wall segments (7-12; 13-16) being at assembling predefined separable, such that said wall segments (10-12; 15-16), which are highly activated by said particle radiation, are constructed separately from said wall segments (7-9; 13-14), which are slightly activated by said particle radiation, and wherein dividing walls are provided between said spallation and moderation layers to enable separated disposal of said spallation and moderation layers.

2. Radiation protection wall (110) according to claim 1, wherein said first layer arrangement is multi-layered and comprises several spallation layers (122, 124) being separable from each other.

3. Radiation protection wall (110) according to claim 1, wherein the radiation protection wall (110) has at least the following layer structure:

a first solid base layer (140), a spallation layer (122), a first dividing wall (92), a first moderation layer (132), a second dividing wall (92), a second moderation layer (134), a second solid base layer (152).

4. Radiation protection wall (110) according to claim 1, wherein in top view said radiation protection wall (110), when being in its operational position, has a two-dimensional modularly sub-divided structure, wherein concerning the planned disassembling in two dimensions—in polar coordinates azimuthal and radial—the structure is adjusted to the expected exposure dose.

5. Radiation protection wall (110) according to claim 1, wherein said moderation layer (132, 134, 136) contains mainly elements with an atomic number less than 30.

6. Radiation protection wall (110) according to claim 1, wherein said spallation layer (122, 124) contains mainly elements with an atomic number greater than 20.

7. Radiation protection wall (110) according to claim 1, wherein said moderation layer (132, 134, 136) has a density less than or equal to 3.5 g/cm$^3$.

8. Radiation protection wall (110) according to claim 1, wherein said spallation layer (122, 124) has a density greater than or equal to 3 g/cm$^3$.

9. Radiation protection wall (110) according to claim 1, wherein said moderation layer (132, 134, 136) contains ground excavation, sand, flint, feldspar, lime feldspar, potassic feldspar and/or gypsum.

10. Radiation protection chamber (1) for a reaction site on a particle accelerator, out of which a primary high energy beam (70) can be directed into said radiation protection chamber (1), thereby creating secondary radiation when hitting a target in said radiation protection chamber, wherein said radiation protection chamber comprises at least a first radiation protection wall (110) positioned downbeam, a second radiation protection wall (210) positioned upbeam with an entry area for said high energy beam, lateral radiation protection walls (310, 410) as well as a ground and a ceiling, wherein the radiation protection walls, the ground and the ceiling together form a radiation protection cage being essentially closed around said reaction site, wherein the first radiation protection wall (110) being positioned downbeam has a central area (10-12, 15, 16, 21) for attenuating the radiation leaving the reaction site in a predefined solid angle around the forward direction of the high energy beam (70) and a peripheral area (7-9, 13, 14, 20) around the central area, wherein the first radiation protection wall (110) being positioned downbeam is made up of separate wall segments (7-12, 13-16, 20, 21) in such a manner that during deconstruction said wall segments from the central area and said wall segments from the peripheral area can be deconstructed separately from each other along predefined boundaries, wherein the sub-dividing of the first radiation protection wall (110) being positioned downbeam is fitted to the anisotropy to a second radiation (90) generated by the high energy beam (70).

11. Radiation protection chamber (1) according to claim 10, wherein the first radiation protection wall (110) and the lateral radiation protection walls (310, 410) have a different structure.

12. Radiation protection chamber (1) according to claim 10, wherein a beam annihilator (95) is arranged in forward direction.

* * * * *